United States Patent [19]

Rautio

[11] Patent Number: 4,764,661

[45] Date of Patent: Aug. 16, 1988

[54] AIR HUMIDIFIER

[76] Inventor: Kauko Rautio, Kolmihaarantie, 52700 Mäntyharju, Finland

[21] Appl. No.: 18,824

[22] Filed: Feb. 24, 1987

Related U.S. Application Data

[63] Continuation of Ser. No. 726,235, Apr. 23, 1985, abandoned.

[30] Foreign Application Priority Data

May 4, 1984 [FI] Finland ..... 841797

[51] Int. Cl.[4] ..... F22B 1/28

[52] U.S. Cl. ..... 219/272; 219/362

[58] Field of Search ..... 219/271–276, 219/362; 126/113; 236/44 R, 44 A, 44 C; 261/DIG. 15, DIG. 34, DIG. 65; 122/40, 41, 379; 165/21, 3, 84, 95; 134/17, 19, 20

[56] References Cited

U.S. PATENT DOCUMENTS

| | | | |
|---|---|---|---|
| 1,828,702 | 10/1931 | Foo | 219/272 |
| 2,201,389 | 5/1940 | DeGive | 219/362 |
| 2,302,528 | 11/1942 | Conklin | 219/273 |
| 2,425,134 | 8/1947 | Strickland | 134/17 |
| 2,561,443 | 7/1951 | March | 219/273 |
| 2,993,107 | 7/1961 | Fichtner | 219/272 |
| 3,072,128 | 1/1963 | James | 122/379 |
| 3,209,124 | 9/1965 | Morrissey | 219/273 |
| 3,323,784 | 6/1967 | Fazio | 219/272 |
| 3,502,309 | 3/1970 | Flores | 219/272 |
| 3,660,635 | 5/1972 | Liebert | 219/273 |
| 4,089,915 | 5/1978 | Jackson | 219/273 |
| 4,139,762 | 2/1979 | Pohrer | 219/362 |
| 4,224,503 | 9/1980 | Gijzel | 122/379 |
| 4,373,430 | 2/1983 | Allen | 219/362 |

FOREIGN PATENT DOCUMENTS

| | | | |
|---|---|---|---|
| 2212448 | 9/1973 | Fed. Rep. of Germany | 219/272 |
| 1553880 | 10/1979 | United Kingdom | 219/273 |

*Primary Examiner*—E. A. Goldberg
*Assistant Examiner*—Teresa J. Walberg
*Attorney, Agent, or Firm*—Browdy and Neimark

[57] ABSTRACT

An air humidifier used for regulating humidity in indoor spaces, such as residential flats, and in which the humidity has been produced by vaporizing water in a vaporizer. The problem in existing air humidifiers is the constant need to add water and the need of other maintenance, such as cleaning. In the air humidifier of the invention, these problems have been solved in the way that the air humidifier is connected to the water mains by means of a pipe. The water flow entering the vaporizer can be controlled with the aid of a valve, and after the water inflow has been stopped by the valve the heat stored in the walls of the vaporizer and in the electric resistance dries the vaporizer, while at the same time burning out the impurities in the vaporizer.

2 Claims, 1 Drawing Sheet

AIR HUMIDIFIER

This application is a continuation of application Ser. No. 726,235, filed Apr. 23, 1985, now abandoned.

FIELD OF THE INVENTION

The present invention concerns an air humidifier which is used for regulating the humidity in indoor spaces, such as residential flats, and in which humidity is produced by vaporizing water in a vaporizer.

BACKGROUND OF THE INVENTION

In modern residential flats and other indoor spaces, especially those which are centrally heated, the air is often too dry. Therefore, endeavours have been made to increase artificially the relative humidity of the room air. Small, electrically operated air humidifiers which are kept on the floor have become popular, in which the vaporizer heats water, converting it into water vapour which, being lighter than air, spreads into the room air from the apparatus.

In practice, air humidifiers of the prior art have however proved inconvenient, and they require a lot of maintenance. The user is most strongly inconvenienced by the water tank of the apparatus, which has to be filled at regular intervals. In addition, the air humidifier must absolutely be cleaned thoroughly fairly often because in use impurities dangerous to health tend to accumulate in the vaporizer and are spread by the apparatus into the room air. The humidity of the ambient air is also overlooked by existing air humidifiers, which instead humidify the room air at a given constant rate all the time.

SUMMARY OF THE INVENTION

The above-mentioned drawbacks associated with air humidifiers of prior art have created the need to develop a better air humidifier. The object of the present invention is therefore to provide an air humidifier which is free of the factors mentioned above impeding its use. The air humidifier of the invention is characterized in that the air humidifier is connected to the water mains by means of a pipe, that the water flow entering the vaporizer can be controlled with the aid of a valve, and that after the water entry has been stopped by the valve the heat stored in the walls of the vaporizer and in the electric resistance dries the vaporizer, at the same time burning out the impurities in the vaporizer. It is thus understood that in the air humidifier of the invention no water tank is needed: the apparatus itself takes care of water intake, without any steps on the part of the user. There is no need to clean the apparatus either, because the vaporizer burns away the bacteria.

An advantageous embodiment of the invention is characterized in that the vaporizer is provided with one or several sensors which sense the amount of water in the vaporizer. With the aid of said sensors, information about the water level in the vaporizer is transmitted to the valve controlling the water input, this valve either opening or closing, in accordance with the situation.

Another advantageous embodiment of the invention is characterized in that the valve is a magnetic shut-off valve receiving its closing and opening signals electrically through a connecting box.

One more advantageous embodiment of the invention is characterized in that the air humifier comprises a sensor measuring the humidity in the room air. Hereby, the humidity of the air is kept on a given, desired level.

DESCRIPTION OF THE DRAWINGS

In the following, the invention is described referring to the drawings attached, wherein

In FIG. 1 is presented the cross-section of the air humidifier of the invention. The body part of the means is indicated by reference numeral 12. The means is connected to the water mains by means of a pipe 6. The water intake from the water mains is controlled by a magnetic shut-off valve 5 which receives its operating signals, or opening and closing commands, electrically from a connecting box 3. The water is vaporized in the vaporizer 2 provided with an electrical resistance heater 13. The vaporizer is thermally insulated with asbestos insulation 10. The water vaporized in the vaporizer is conducted into the room air through an output nozzle 1.

DETAILED DESCRIPTION OF THE INVENTION

Figure 1:
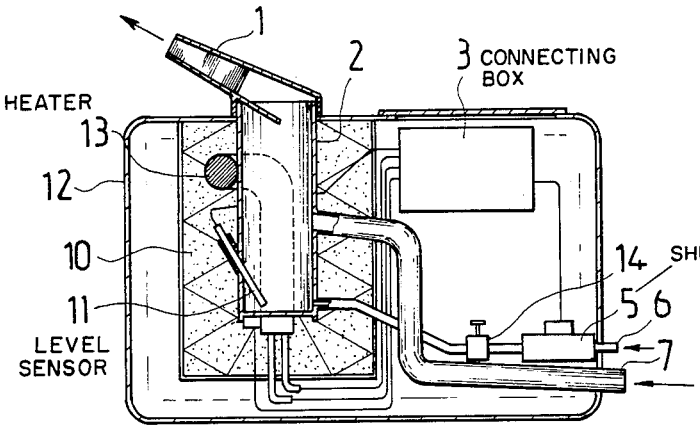
FIG. 1 presents a cross-section of the air humidifier of the invention.
Figure 2:
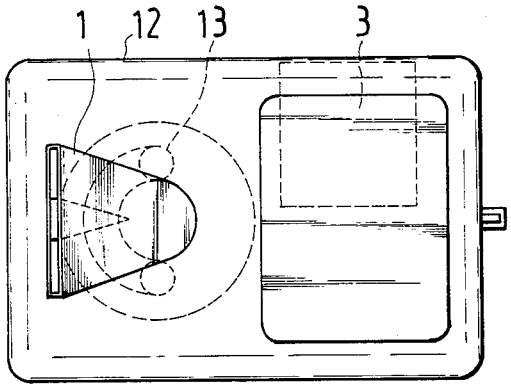
FIG. 2 shows the air humidifier in top view.
Figure 3:
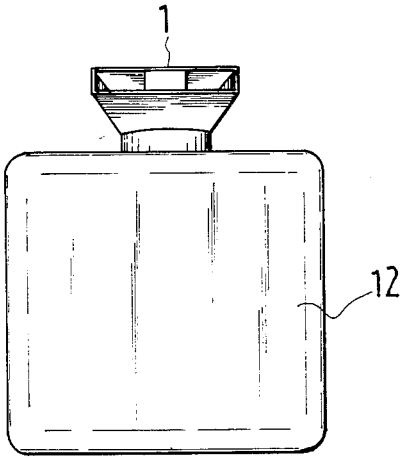
FIG. 3 shows the air humidifier in elevational view.

The operation of the air humidifier of the invention shall be examined more in detail with the aid of an example. The humidity of the room air is measured by means of a sensor, not depicted in the figure. When the sensor observes that the humidity content in the air has gone down it transmits an opening pulse to the magnetic shut-off valve 5 inserted in the pipe 6. The water is now admitted to flow from the water mains through a throttling valve with suitable setting into the vaporizer 2, and the water level begins to rise, reaching the level sensor 11 measuring the water level and supplying through the connecting box 3 to the magnetic shut-off valve 5 a closing pulse and transmitting a switch-on pulse to the electric resistance heater 13 heating the vaporizer 2, whereby, after the vaporizer has heated up, the water begins to vaporize and the water vapour thus produced rises from the vaporizer through the output nozzle 1 into the room air. When hereafter the water level falls, the valve 5 naturally opens again. The sensor measuring the humidity in the room space monitors the air humidity all the time, and when sufficient humidity has been reached, said sensor supplies over the connecting box 3 a closing pulse to the magnetic shut-off valve 5 and to the electrical resistance heater 13. After the water inflow has ceased, the heat stored in the walls of the vaporizer 2 and in the electrical resistance heater 13 evaporates the water remaining in the vaporizer and also heats the bottom part of the vaporizer to such high temperature that all impurities burn out. If needed, it is possible to switch the heating resistance off only after a suitable period of time has passed since the water inflow has stopped.

With a view to spreading the humidity more efficiently in the room air, the means may be provided with an electric fan. Moreover, an air freshener may be incorporated in the air humidifier.

It is obvious to a person skilled in the art that the invention is not confined to the above-mentioned embodiment example and that it may be modified within the scope of the claims following below.

I claim:

1. An air humidifier comprising:

a pipe connecting the humidifier to a source of water;

a valve for controlling the flow of water to the humidifier into a vaporizer;

said vaporizer provided near the bottom thereof with at least one level sensor to sense the water level in the vaporizer, said at least one level sensor controlling the opening or closing of said valve;

said humidifier provided with at least one humidity sensor to measure the humidity in the environs of the humidifier;

an electric resistance heater placed outside the vaporizer for vaporizing water;

said electric resistance heater including a heating element adapted to burn off impurities from an inside surface of said vaporizer;

said electric resistance heater evaporating water remaining in the vaporizer after the humidity sensor has determined that the humidity of the environs has reached a predetermined level;

an output nozzle for conducting water vapor out of the humidifier;

wherein the electric resistance heater is located outside of the vaporizer in close proximity to the vaporizer.

2. An air humidifier according to claim 1 wherein said valve is a magnetic shut-off valve receiving its closing and opening signals electrically from a connecting box.

* * * * *